US005637193A

United States Patent [19]

Hassi et al.

[11] Patent Number: 5,637,193

[45] Date of Patent: Jun. 10, 1997

[54] BLEACHING AND COATING A PAPER WEB WITH PEROXIDE AND STARCH

[75] Inventors: Heikki Y. Hassi, Kuusankoski; Markku T. O. Johansson, Kouvola; Outi-Maija K. Teittinen, Kuusankoski, all of Finland

[73] Assignee: Kymi Paper Mills Ltd., Finland

[21] Appl. No.: 355,079

[22] Filed: Oct. 24, 1994

[51] Int. Cl.[6] ..... D21C 9/16; D21H 21/32

[52] U.S. Cl. ..... 162/78; 162/175; 162/181.1; 162/184

[58] Field of Search ..... 162/175, 181.1, 162/184, 177, 78

[56] References Cited

U.S. PATENT DOCUMENTS 2,613,579 10/1952 McEwen et al. .
3,211,564 10/1965 Lauterbach ..... 106/214
3,467,575 9/1969 Wayman et al. .
3,475,215 10/1969 Maurer ..... 127/33
4,435,248 3/1984 Arakawa .

*Primary Examiner*—Steven Alvo
*Attorney, Agent, or Firm*—Klarquist Sparkman Campbell Leigh & Whinston, LLP

[57] ABSTRACT

A method for bleaching a paper web with peroxide and to a paper surface treatment mixture intended for such a method. According to the invention, peroxide is introduced onto a moving paper web as part of the said mixture, which in addition to the peroxide contains another active component, such as a bonding agent or a surface coating, to be introduced onto the web. The bonding agent may be made up of starch and a surface coating pigment, such as calcium carbonate, kaolin or talc. Peroxide is added to these so that its amount on each side of the web to be bleached will be approx. 0.08–1.0 g/m$^2$.

11 Claims, No Drawings

BLEACHING AND COATING A PAPER WEB WITH PEROXIDE AND STARCH

This is a continuation of international application Ser. No. PCT/FI93/00169, filed Apr. 23, 1993.

The present invention relates to a method of bleaching a paper web with peroxide. The invention additionally relates to a paper surface treatment mixture intended for such a method.

Peroxide treatment of the web in connection with a paper making process has been used for the sterilization of paper. In addition, the literature describes methods in which peroxide is used for bleaching a pulp web. Thus there are known both the bleaching of an unbleached or semibleached pulp web by peroxide spraying and the bleaching of a web after the pressing stage by means of rolls moistened with a peroxide solution. DE patent publication 2 409 981 discloses a method in which a paper web is bleached with a bleaching chemical sprayed through slit nozzles mounted across the web; according to the invention, this chemical may be peroxide or dithionite. However, the publication contains no embodiment examples of the use of peroxide.

The bleaching of a paper web by means of a peroxide solution involves obvious problems. If the peroxide solution is strong, dosing it evenly over the paper web is difficult, and at the same time peroxide is consumed in unnecessarily large quantities. If, on the other hand, the solution is diluted with water, the web becomes wet, and consequently the drying costs increase.

The object of the present invention is to provide a new alternative method for bleaching a paper web with peroxide, such as hydrogen peroxide or a suitable inorganic or organic peroxide compound, avoiding the above-mentioned disadvantages of the state-of-the-art technology. The bleaching method according to the invention is characterized in that the peroxide is introduced onto a moving paper web as part of the mixture intended for surface treatment of the web; in this mixture another active component, such as a bonding agent or a surface coating agent, is introduced onto the web in addition to peroxide.

Treating a paper web with a bonding agent in order to bond the fibers to each other and surface coating a paper web in order to improve the printability of the paper are integral stages of normal paper making. The basic idea of the present invention is to combine peroxide bleaching of the web with these treatment stages which belong to the process anyway. In this case the bleaching will not increase the number of web treatment stages and will not cause an additional drying requirement. The concentration of peroxide in the mixture to be introduced onto the web can easily be adjusted to a suitably low level, whereby an even and quantitatively sufficient bleaching effect will be achieved while the consumption of peroxide will remain low.

Preliminary experiments have shown that the invention works. The bleaching effect of peroxide will not suffer from the peroxide being mixed with a bonding agent or a surface coating, and, on the other hand, peroxide will not interfere with sizing with a bonding agent or coating. When peroxide bleaching according to the invention was combined with the surface sizing of paper, for example the surface strength of the paper remained unchanged.

According to preliminary experiments, peroxide bleaching according to the invention is also independent of a possible presence of a fluorescent whitening agent. A whitening agent, such as Tinopal (Ciba Geigy), which contains a stilbene derivative and converts UV radiation to visible light, has so far been added, for example, to paper surface sizing, precoating, or stock. Recently, suspicions have arisen that these substances are toxic, and the present invention provides a possibility of replacing them in part or entirely with a peroxide treatment.

One of the basic embodiments of the present invention is that the peroxide is introduced onto the paper web mixed with a starch used as the bonding agent. The mixture may be an aqueous solution in which the concentration of starch is 1–30, preferably 3–15% by weight, and the concentration of peroxide is preferably 1–40% by weight. The starches are in general modified, but according to the invention also the use of native starch is possible. The peroxide may be combined with the starch simply along with the dilution water.

In addition to starch, also CMC, latexes or proteins are possible as the bonding agent.

Another basic embodiment of the invention is to introduce the peroxide onto the paper web mixed with a pigment used as a surface coating. Such a pigment mixture may also contain a bonding agent. Some common pigments are calcium carbonate, kaolin, and talc, and according to the invention the peroxide can be mixed into a slurry made of these. Synthetic, organic pigments can be mentioned as other possible pigments.

An optimal bleaching effect is obtained when peroxide is introduced onto each side of the paper web at approx. 0.08–1.0 g/m$^2$ in the treatment mixture.

One method of introducing a peroxide-containing surface treatment mixture onto a paper web is blade coating, in which the mixture is fed, from a trough transverse to the moving web, to a coating blade which is against the web. In preliminary experiments, good results have been achieved by this procedure. Other advantageous methods of spreading the mixture include roll coating and the use of various surface-sizing presses.

As was noted, the invention also relates to a surface treatment mixture for the method described above. According to the invention the mixture is characterized in that it contains peroxide and a coating treatment material made up of a bonding agent and/or a coating. According to preliminary experiments, such a mixture can be prepared without the peroxide having a detrimental effect on the bonding agent or the coating pigment. The mixture also has sufficient stability so that it can be introduced onto the web before the decomposition of the peroxide.

The mixture according to the invention may be made up of peroxide and a starch used as a bonding agent, for example so that the mixture is an aqueous solution containing peroxide approx. 1–40% by weight and starch 1–30% by weight, preferably approx. 3–15% by weight.

Alternatively, the mixture according to the invention may be made up of a slurry which contains peroxide, a bonding agent such as starch, a pigment constituting the surface coating, and water. The precise composition of the slurry may vary greatly, depending on the intended end use of the paper. In a slurry suitable for pre-coating, the composition of the solids is preferably peroxide approx. 1–10%, bonding agent such as starch approx. 10–15%, and pigment approx. 70–90%. The proportion of water in the pre-coating slurry is preferably approx. 15–20%. In a slurry suitable for use as a pigmenting mixture, the solids for their part are preferably made up of peroxide approx. 4–40%, bonding agent such as starch approx. 30–60%, and pigment approx. 20–50%. A suitable proportion of water in the pigmenting slurry is approx. 75–90%.

Preliminary laboratory experiments carried out with the invention are described below.

PRELIMINARY BLEACHING

A surface treatment mixture which had been produced by diluting oxidized corn starch (Amisol) having an initial consistency of 12% down to 6% with water or with a mixture of water and hydrogen peroxide was applied by the blade coating method to a once surface-sized wood-free base paper (KymArt), the initial whiteness of which was 81.9%. The development of the whiteness was monitored for three weeks, and the surface strength values were measured. The results are presented in the following Table 1.

TABLE 1

| Mixture | Peroxide dose, g/m² | Whiteness, % Immediately | 3 d | 7 d | 14 d | 21 d | Surface strength IGT, HV m/min |
|---|---|---|---|---|---|---|---|
| 50 g starch + 50 g water | 0 | 81.9 | 82.4 | 82.6 | 82.6 | 82.7 | 1.65 |
| 50 g starch + 50 g peroxide (40 g/l) | 0.17 | 82.3 | 84.2 | 84.7 | 84.9 | 85.2 | 1.65 |
| 50 g starch + 50 g peroxide (80 g/l) | 0.36 | 82.5 | 84.6 | 85.2 | 85.3 | 85.6 | 1.70 |

The results show the clear bleaching effect of the peroxide combined with starch, which bleaching effect is substantially as good as when peroxide is used alone (observed in a reference experiment). In addition, it is seen that the use of peroxide has no detrimental effect on the paper surface strength obtained by means of starch.

STABILITY OF THE SURFACE TREATMENT MIXTURE

The stability of the starch solution which contained hydrogen peroxide was tested by measuring the viscosity and peroxide concentration of the solution at 50° C. at predetermined intervals for one day. The solution was an aqueous solution having a starch concentration of 6% and a peroxide concentration of 0, 2 or 4%. After it had been shown that the pH of the solution dropped during one-day storage from 7.2 to 2.1 because of the peroxide, the series was further supplemented with a solution the initial pH of which was raised by means of lye from 6.6 to 7.8, whereupon the pH level remained at an acceptable level for a couple of hours. The measuring results are shown in the following Table 2.

TABLE 2

| Solution | Immediately | 15 min | 1 h | 2 h | 6 h | 23 h |
|---|---|---|---|---|---|---|
| | Viscosity, mPa · s | | | | | |
| Starch | 26.5 | 24.0 | 23.2 | 23.0 | 21.9 | 21.8 |
| Starch + 2% peroxide | 26.0 | 26.2 | 22.5 | 24.7 | 17.1 | 11.2 |
| Starch + 4% peroxide | 26.5 | 25.0 | 24.0 | 19.4 | 13.8 | 9.0 |
| Starch + 2% peroxide initial pH -> 7.8 | 40.5 | 32.8 | 27.8 | 28.8 3 h | 22.9 | 15.2 |

TABLE 2-continued

| Solution | Immediately | 15 min | 1 h | 2 h | 6 h | 23 h |
|---|---|---|---|---|---|---|
| | Peroxide concentration, g/l | | | | | |
| Starch + 2% peroxide | 20.3 | 19.2 | 19.6 | 18.9 | 17.6 | 2.8 |
| Starch + 4% peroxide | 40.9 | 40.1 | 37.8 | 37.1 | 34.0 | 0.2 |
| Starch + 2% peroxide initial pH -> 7.8 | 19.8 | 19.5 | 18.1 | 16.2 3 h | 15.1 | 0.8 |

The results show that the viscosity of the solution containing peroxide was retained for two hours quite well as compared with the solution containing only starch, but had clearly dropped after six hours, more with the stronger solution than with the dilute solution, and after 23 hours it was only approx. one-half of the viscosity of the starch solution. A raising of the pH of the solution increased the initial viscosity, and this difference was largely retained for 23 hours.

According to the results, the peroxide concentration of the solution was retained well for six hours, but in one day it had dropped to nearly zero. An increase of the pH of the solution somewhat increased the rate of peroxide decomposition.

Since on the basis of the results the starch solution which contained peroxide seemed to retain its properties to a reasonable degree for approx. six hours, a further experiment was performed to test the bleaching properties of such solution which had been stored for six hours. Thus an aqueous solution was prepared which contained starch 6% and hydrogen peroxide 2%, the solution was stored for six hours at 50° C., and the solution was applied to paper as in the preliminary bleaching experiments described above. The result is shown in the following Table 3, which shows that the bleaching effect was in the same order as with the fresh solutions, and that the solution thus remained usable for approx. six hours.

TABLE 3

| Whiteness, % Immediately | 5 d | 18 d | 32 d | Increase of whiteness, % units 5 d | 18 d | 32 d | Surface strength, HV, m/min |
|---|---|---|---|---|---|---|---|
| 82.1 | 84.1 | 85.1 | 85.3 | 2.0 | 3.0 | 3.2 | 2.4 |

STARCH/PEROXIDE BLEACHING WITH DIFFERENT PEROXIDE DOSAGES

A series of experiments was performed with solutions which were 6% solutions with respect to Amisol starch and to which different amounts of hydrogen peroxide had been added as part of the dilution water so that the peroxide dosing onto the paper web varied within a range of approx. 0.1–1 g/m². The solutions were used for surface sizing once-sized wood-free KymArt base paper having a weight of 71.4 g/m² and an initial whiteness of 82.3% (experiments 1–7), and an unsized web the weight of which was 49.0 g/m² (experiments 8–9). The sizing was carried out by blade coating in the same manner as in the preliminary-bleaching experiments described above. The results are shown in the following Table 4.

TABLE 4

| Exp. | Starch dose, g/m² | Peroxide dose, g/m² | Whiteness, % Immediately | 1 d | 4 d | 7 d | 14 d | 28 d | Surface strength IGT HV, m/min |
|---|---|---|---|---|---|---|---|---|---|
| 1 | 0.509 | 0 | 81.6 | 81.7 | 81.9 | 81.9 | 82.2 | 82.1 | 1.9 |
| 2 | 0.529 | 0.088 | 82.1 | 82.8 | 83.7 | 84.1 | 84.7 | 84.9 | 2.1 |
| 3 | 0.517 | 0.172 | 82.3 | 83.2 | 84.0 | 84.5 | 85.1 | 85.4 | 2.4 |
| 4 | 0.505 | 0.337 | 82.5 | 83.5 | 84.4 | 84.9 | 85.5 | 85.8 | 2.2 |
| 5 | 0.535 | 0.535 | 82.7 | 83.8 | 84.6 | 85.1 | 85.8 | 86.1 | 2.4 |
| 6 | 0.547 | 0.729 | 82.7 | 83.9 | 84.7 | 85.2 | 85.9 | 86.3 | 2.4 |
| 7 | 0.529 | 0.882 | 82.8 | 83.9 | 84.8 | 85.4 | 86.1 | 86.4 | 2.4 |
| 8 | 0.494 | 0.165 | 85.0 | 86.2 | 87.2 | 87.7 | 88.5 | 88.9 | 0.6 |
| 9 | 0.524 | 0.524 | 85.2 | 86.7 | 87.9 | 88.5 | 89.1 | 89.5 | 0.5 |

The results show that a considerable increase of whiteness is achieved in the paper even with the lowest peroxide doses.

BLEACHING WITH A STARCH/PIGMENT/PEROXIDE MIXTURE

Blade coating was performed on a once-sized KymArt base paper having an initial whiteness of 82.3%, by using aqueous slurries which contained starch, calcium carbonate (Hydrocarb 90, 94–95% whiteness) or kaolin (SPS, 85–86% whiteness) as the pigment, hydrogen peroxide, and a fluorescent whitening agent (Tinopal), the total coating amount being approx. 2 g/m². Some of the mixtures were reference mixtures from which the pigment, peroxide or fluorescent whitening agent had been omitted. The results of the bleaching are shown in the following Table 5.

TABLE 5

| Starch 100 parts | Pigment 80 parts | Tinopal 4.5 parts | Peroxide, g/m² | Whiteness, % 0 d | 1 d | 3 d (4 d) | 6 d (7 d) |
|---|---|---|---|---|---|---|---|
| + | – | – | 0.34 | 82.5 | 83.5 | 84.4 | 84.9 |
| + | Hydrocarb 90 | + | 0 | 84.9 | 85.0 | 85.1 | 85.2 |
| + | Hydrocarb 90 | + | 0.27 | 85.7 | 86.7 | 87.3 | 87.8 |
| + | Hydrocarb 90 | – | 0.27 | 83.1 | 83.8 | 84.4 | 84.9 |
| + | Hydrocarb 90 | – | 0 | 82.0 | 82.1 | 82.2 | 82.3 |
| + | SPS | + | 0 | 84.5 | 84.5 | 84.6 | 84.8 |
| + | " | + | 0.33 | 85.3 | 85.6 | 86.9 | 87.3 |
| + | " | – | 0.35 | 82.5 | 83.0 | 83.9 | 84.3 |
| + | " | – | 0 | 81.5 | 81.5 | 81.9 | 82.0 |

These results show that peroxide serves as a bleaching agent also in a slurry used for the pigmenting of paper. It can also be seen that a fluorescent whitening agent increases the degree of whiteness of paper but does not have a significant effect on the increase in the degree of whiteness produced by peroxide.

WHITENING COMBINED WITH PRECOATING

A coating paste which contained, calculated of its wet weight, a calcium carbonate pigment (Hydrocarb 90) 67.4%, starch 9.5%, a bonding agent containing latex and CMC 7.2%, and either peroxide or water 14.5% was applied to a wood-free KymArt base paper by the blade coating method in the same manner as in the experiments described above. Thereafter the final coating was introduced onto the paper in the same manner, the final coating containing a more finely ground calcium carbonate, kaolin, carboxymethyl cellulose, latex, and water. The increase in whiteness was measured during the next three weeks, and the results of these measurements are shown in the following Table 6.

TABLE 6

| Pre-coating | Final coating | Peroxide g/m² | Whiteness, % 0 d | 1 d | 6 d | 10 d | 20 d |
|---|---|---|---|---|---|---|---|
| + | – | 0 | 85.4 | 86.1 | 86.2 | 86.2 | 86.3 |
| + | + | 0 | 88.8 | 89.4 | 89.5 | 89.5 | 89.7 |
| + | – | 0.32 | 87.4 | 88.4 | 89.1 | 89.5 | 89.8 |
| + | + | 0.32 | 89.9 | 90.8 | 91.2 | 91.4 | 91.7 |

The results show that peroxide bleaching was successful also when combined with the precoating, and it increased the final whiteness of the paper also when a final coating was carried out on the paper, even if the final coating covered some of the increase in whiteness.

For an expert in the art it is clear that the invention is not limited to what is shown by the above example experiments; the invention may vary within the following patent claims.

We claim:

1. A method for bleaching and coating a paper web with peroxide and starch, comprising the steps of introducing the peroxide and starch onto a surface of a moving paper web as part of a mixture intended for the surface treatment of the web, the mixture including an effective amount of peroxide to bleach the paper web and an effective amount of starch to coat the surface and bond paper fibers following the step of introducing, the peroxide being mixed with a starch used as a bonding agent before the step of introducing.

2. A method according to claim 1, wherein the mixture also contains a pigment selected from the group consisting of calcium carbonate and kaolin the pigment being used as a surface coating.

3. The method according to claim 1, wherein the peroxide is introduced onto both sides the paper web at a density of approximately 0.08–1.0 g/m².

4. A method for bleaching and coating a paper web with peroxide and starch, comprising:

forming an aqueous mixture comprising from about 1 to about 30 weight percent starch, and from about 1 to about 40 weight percent peroxide;

providing a moving cellulosic fibrous web; and applying the mixture to the moving web at a density of from about 0.08 to about 1.0 g/m² wherein the applied mixture contains an effective amount of peroxide to bleach the web and an effective amount of starch to coat the web surface and bond the web fibers.

5. The method according to claim 4 wherein the web includes first and second major opposed surfaces, and the applying step comprises applying the mixture to both major opposed surfaces.

6. The method according to claim 4 wherein the forming step comprises forming an aqueous mixture at a temperature of from about ambient temperature to less than about 50° C.

7. The method according to claim 4 wherein the mixture is applied to the web within about 6 hours following the forming step.

8. The method according to claim 4 wherein the starch is an oxidized starch prior to the step of forming the mixture.

9. A method for bleaching and coating a paper web with peroxide and starch, comprising:

forming a mixture comprising from about 1 to about 30 weight percent oxidized starch, and from about 1 to about 40 weight percent peroxide;

providing a moving cellulosic fibrous web, the fibrous web having first and second major opposed surfaces; and applying the mixture to the first and second opposed surfaces of the moving fibrous web at a density of from about 0.08 $g/m^2$ to about 1.0 $g/m^2$, thereby providing an effective amount of peroxide to bleach the first and second surfaces of the fibrous web and an effective amount of starch to coat the first and second opposed surfaces and to bond the web fibers.

10. The method according to claim 9 wherein the mixture has an initial viscosity, and the step of applying the mixture occurs before any substantial change occurs in the initial viscosity.

11. The method according to claim 9 wherein the mixture is applied to the web within about 6 hours following the forming step.

* * * * *